US011079695B2

(12) United States Patent
Sato et al.

(10) Patent No.: US 11,079,695 B2
(45) Date of Patent: Aug. 3, 2021

(54) TONER EXTERNAL ADDITIVE AND TONER

(71) Applicant: CANON KABUSHIKI KAISHA, Tokyo (JP)

(72) Inventors: Kazuyuki Sato, Yokohama (JP); Masao Suzuki, Kawasaki (JP); Masashi Hirose, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/819,736

(22) Filed: Mar. 16, 2020

(65) Prior Publication Data

US 2020/0301303 A1 Sep. 24, 2020

(30) Foreign Application Priority Data

Mar. 19, 2019 (JP) ..... JP2019-051296

(51) Int. Cl.
*G03G 9/097* (2006.01)
*G03G 9/113* (2006.01)

(52) U.S. Cl.
CPC ..... *G03G 9/1138* (2013.01)

(58) Field of Classification Search
CPC ..... G03G 9/09708; G03G 9/09716; G03G 9/09725
See application file for complete search history.

(56) References Cited

U.S. PATENT DOCUMENTS 4,680,245 A * 7/1987 Suematsu ..... G03G 9/0918 428/404
5,429,873 A 7/1995 Deusser et al.
6,316,155 B1 11/2001 Kudo et al.
8,178,272 B2 5/2012 Rimoto et al.
8,211,606 B2 7/2012 Murai et al.
8,377,616 B2 2/2013 Tani et al.
8,628,899 B2 1/2014 Kawamura et al.
8,815,484 B2 8/2014 Tanaka et al.
9,012,115 B2 4/2015 Ujifusa et al.
9,134,639 B2 9/2015 Nakano et al.
9,146,485 B2 9/2015 Tani et al.
9,556,290 B2 1/2017 Nishiura et al.
9,715,187 B2 7/2017 Mukumoto et al.
10,151,990 B2 12/2018 Suzuki et al.
10,216,107 B2 2/2019 Tsubaki et al.
10,295,920 B2 5/2019 Nishikawa et al.
10,303,075 B2 5/2019 Tanaka et al.
2005/0209364 A1 9/2005 Yamagishi et al.
2013/0202998 A1 8/2013 Higashi et al.
2014/0356779 A1 12/2014 Hasegawa et al.
2014/0377697 A1 12/2014 Nishiura et al.
2015/0004539 A1 1/2015 Watanabe et al.
2019/0384197 A1 12/2019 Aoki et al.
2019/0384198 A1 12/2019 Matsui et al.
2019/0384200 A1 12/2019 Kamikura et al.

FOREIGN PATENT DOCUMENTS

JP H04-231318 8/1992
JP 2000-330328 11/2000
JP 2009-086652 4/2009
JP 2013-249400 * 12/2013 ..... C09D 201/00

OTHER PUBLICATIONS

Translation of JP 2013-249400.*
U.S. Appl. No. 16/868,635, Komiya et al., filed May 7, 2020.
U.S. Appl. No. 16/880,017, Nagaoka et al., filed May 21, 2020.

* cited by examiner

*Primary Examiner* — Peter L Vajda
(74) *Attorney, Agent, or Firm* — Venable LLP

(57) ABSTRACT

Provided is a toner external additive containing a base material, wherein the base material is surface-treated with an isocyanurate ring-bearing silane coupling agent, and a toner including a toner particle and a toner external additive on a surface of the toner particle, wherein the toner external additive is the aforementioned toner external additive.

6 Claims, No Drawings

TONER EXTERNAL ADDITIVE AND TONER

BACKGROUND OF THE INVENTION

Field of the Invention

The present disclosure relates to a toner external additive and a toner that are used in image-forming methods such as electrophotographic methods.

Description of the Related Art

Electrophotographic technology is a technology in which an electrostatic latent image is formed on a uniformly charged photosensitive member and the image information is then made visible using a charged toner.

Electrophotographic technology is used in devices such as copiers and printers.

Electrophotographic devices have seen a broadening of their fields of application along with technical advances, and they have also been subject to a variety of demands for added value, such as a smaller machine size and longer machine life, in addition to demands for higher speeds and higher image quality.

The use environment has also become quite diverse, and there is demand that high-quality images be provided on a long-term basis even in harsh environments, such as the high-temperature, high-humidity environments that facilitate a reduction in toner charging performance.

In order to respond to these demands, an optimal constitution is required for the toner, which is a composite material of, e.g., binder resin, external additive, wax, and so forth.

Among these, the external additive, which is added to the toner particle surface, has assumed a particularly large role in controlling the charging performance and flowability of toners.

The following, for example, are used for the base material of external additives: inorganic fine particles, e.g., silica fine particles, titania fine particles, alumina fine particles, and so forth, as well as resin fine particles and organic/inorganic composite fine particles formed from a resin and an inorganic material.

Japanese Patent Application Laid-open No. 2000-330328 proposes an external additive for a high-flowability toner, wherein hydrophilic silica fine particles are hydrophobed by the execution thereon of a surface treatment with an alkylalkoxysilane compound.

Japanese Patent Application Laid-open No. H4-231318 proposes a toner external additive that supports a fast charge rise rate, which is achieved by carrying out a surface treatment with a fluorosilane compound on a pyrolytically produced silica.

Japanese Patent Application Laid-open No. 2009-086652 proposes a toner external additive that supports a rapid charge rise rate and enables long-term maintenance of the amount of charge even in high-temperature, high-humidity environments. This is achieved by carrying out a surface treatment with a fluorosilane compound on a titania that has at least 0.2% of a water-soluble component.

SUMMARY OF THE INVENTION

Among these heretofore used surface treatments for toner external additives, surface treatment using an alkylalkoxysilane compound can raise the hydrophobicity of an external additive through a highly efficient surface treatment of the base material. However, it cannot be said that the negative charge-providing performance is high, and a problem has been a slow charge rise rate in use as a toner external additive.

On the other hand, surface treatment with a fluorosilane compound does provide a high negative charge-providing performance and provides a rapid charge rise rate in use as a toner external additive.

However, due to the low surface free energy possessed by the fluorine atom, the efficiency of the surface treatment is low for various base materials, and in order to increase the hydrophobicity it has in some cases been necessary to carry out treatment using a large amount of the coupling agent.

In addition, with the goal of obtaining a satisfactory hydrophobicity, another surface treatment, e.g., with an alkylalkoxysilane compound, may also be used in combination with surface treatment with a fluorosilane compound.

However, the charge rise rate provided by the fluorosilane compound has been reduced in some cases.

Moreover, fluorosilane compounds can have a low adhesiveness for base materials, and there has thus been room for additional investigations with regard to the long-term maintenance of the amount of charge in high-temperature, high-humidity environments.

The present disclosure provides a toner external additive that is highly hydrophobic and, when used for a toner, supports a fast charge rise rate and enables long-term maintenance of the amount of charge in high-temperature, high-humidity environments. The present disclosure also provides a toner.

The present disclosure relates to a toner external additive containing a base material, wherein the base material is surface-treated with an isocyanurate ring-bearing silane coupling agent.

The present disclosure also relates to a toner including a toner particle and a toner external additive on a surface of the toner particle, wherein the toner external additive is the aforementioned toner external additive.

The present disclosure can thus provide: a toner external additive that is highly hydrophobic and, when used for a toner, supports a fast charge rise rate and enables long-term maintenance of the amount of charge in high-temperature, high-humidity environments; and a toner.

Further features of the present invention will become apparent from the following description of exemplary embodiments.

DESCRIPTION OF THE EMBODIMENTS

Unless specifically indicated otherwise, the expressions "from XX to YY" and "XX to YY" that show numerical value ranges refer in the present disclosure to numerical value ranges that include the lower limit and upper limit that are the end points.

A detailed description is provided hereinbelow.

The toner external additive is a toner external additive (also referred to hereinbelow simply as an external additive) containing a base material, wherein the base material is surface-treated with an isocyanurate ring-bearing silane coupling agent.

The toner is a toner including a toner particle and the toner external additive on a surface of the toner particle.

The external additive, because it has the constitution described above, is highly hydrophobic and, when used for toner, supports a fast charge rise rate and enables the maintenance of the amount of charge on a long-term basis in high-temperature, high-humidity environments.

The present inventors hypothesize as follows with regard to the reasons for this.

The isocyanurate ring-bearing silane coupling agent has the isocyanurate group as a reactive function group, and is tightly adhered to the base material surface by a dehydration condensation reaction of the Si-bonded hydrolyzable groups.

The isocyanurate group is a highly polar functional group and a large negative charge is then provided by contact charging.

In addition, fluorine atom-containing silane coupling agents have a low surface free energy, and this results in a reduced surface treatment efficiency for various base materials. In contrast, the isocyanurate ring-bearing silane coupling agent has a high polarity and due to this exhibits a high adhesiveness for diverse base materials and enables a highly efficient surface treatment.

As a result, large property variations do not occur, even with the application of long-term rubbing, with a toner external additive having an isocyanurate ring-bearing silane coupling agent at the base material surface.

That is, a high hydrophobicity is maintained by this external additive even under the application of long-term rubbing. In addition, when this external additive is added to a toner particle, the resulting toner exhibits a fast charge rise rate due to the polarity of the isocyanurate group and is also able to maintain the amount of charge on a long-term basis in high-temperature, high-humidity environments.

The isocyanurate ring-bearing silane coupling agent selected from known isocyanurate ring-bearing silane compounds can be used.

Specific examples include tris(3-trimethoxysilylpropyl) isocyanurate, tris(3-triethoxysilylpropyl) isocyanurate, tris(3-methyldimethoxysilylpropyl) isocyanurate, tris(3-methyldiethoxysilylpropyl) isocyanurate, 1-(3-trimethoxysilylpropyl)-3,5-bis(carboxymethyl) isocyanurate, 1-(3-trimethylsilylpropyl)-3,5-bis(carboxymethyl) isocyanurate, and 1,3-bis(3-trimethylsilylpropyl)-5-(carboxymethyl) isocyanurate, and hydrolyzates thereof.

Among these, at least one selected from the group consisting of a silane compound represented by formula (I) below and hydrolyzates of the silane compound is preferred. These exhibit a highly efficient surface treatment of the base material and provide a high hydrophobicity and a fast charge rise rate.

(I)

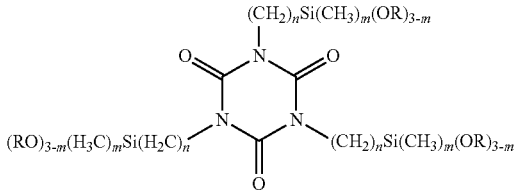

Each R independently represents a $C_{1-6}$ monovalent hydrocarbon group; n represents an integer from 1 to 10; and m represents 0 or 1.

Preferably each R is independently a $C_{1-3}$ monovalent hydrocarbon group. The n is preferably an integer from 1 to 4. The m is preferably 0.

Among these isocyanurate ring-bearing silane coupling agents, at least one selected from the group consisting of tris(3-trimethoxysilylpropyl) isocyanurate and tris(3-triethoxysilylpropyl) isocyanurate and hydrolyzates of these compounds is preferred from the standpoint of additional enhancements in the surface treatment efficiency, the hydrophobicity, and the charge rise rate.

A single one of these isocyanurate ring-bearing silane coupling agents may be used by itself or a mixture of two or more may also be used.

The amount of the base material treated with the silane coupling agent, per 100 mass parts of the base material, is preferably 0.1 mass parts to 80.0 mass parts, more preferably 0.1 mass parts to 30.0 mass parts, and still more preferably 1.0 mass parts to 30.0 mass parts.

When the amount of the base material treated falls within this range, transfer of the silane coupling agent from the external additive to other members is suppressed and as a consequence the amount of charge can then be better maintained on a long-term basis in high-temperature, high-humidity environments.

In addition to surface treatment with the isocyanurate ring-bearing silane coupling agent, the base material may also be subjected to surface treatment, within a range that does not influence the present effects, with an additional silane compound such as a silicone oil, alkoxysilane compound, silazane compound, or silane coupling agent bearing no isocyanurate ring. The surface treatment with the additional silane compound may be carried out at the same time as the surface treatment with the isocyanurate ring-bearing silane coupling agent.

The alkoxysilane compound here can be exemplified by the following:

methyltrimethoxysilane, dimethyldimethoxysilane, n-propyltrimethoxysilane, isobutyltrimethoxysilane, phenyltrimethoxysilane, tetramethoxysilane, tetraethoxysilane, methyltriethoxysilane, dimethyldiethoxysilane, n-propyltriethoxysilane, isobutyltriethoxysilane, phenyltriethoxysilane, and so forth.

The silazane compound here can be exemplified by hexamethyldisilazane, hexaethyldisilazane, tris(trimethylsilyl) amine, bistrimethylsilylmethylamine, and so forth.

The silane coupling agent bearing no isocyanurate ring can be exemplified by vinylsilanes such as vinyltrimethoxysilane and vinyltriethoxysilane, styrylsilanes such as p-styryltrimethoxysilane, acrylsilanes such as 3-acryloxypropyltrimethoxysilane, methacrylsilanes such as 3-methacryloxypropylmethyldimethoxysilane and 3-methacryloxypropyltrimethoxysilane, and aminosilanes such as N-2-(aminoethyl)-3-aminopropylmethyldimethoxysilane and N-2-(aminoethyl)-3-aminopropyltrimethoxysilane.

Among the preceding, those containing three or more hydrolyzable groups are preferred.

A single one of the additional silane compounds may be used by itself or a mixture of two or more may also be used.

The amount of the base material treated with the additional silane compound, per 100 mass parts of the base material, is preferably 0.1 mass parts to 80.0 mass parts and more preferably 0.1 mass parts to 30.0 mass parts. The hydrophobicity of the external additive can be further increased when the amount of the base material treated is in the indicated range.

The silicone oil here has a viscosity at 25° C. preferably of 0.5 $mm^2/s$ to 10,000 $mm^2/s$, more preferably of 1 $mm^2/s$ to 1,000 $mm^2/s$, and still more preferably of 10 $mm^2/s$ to 200 $mm^2/s$.

Specific examples are dimethylsilicone oil, methylphenylsilicone oil, α-methylstyrene-modified silicone oil, chlorophenylsilicone oil, and fluorine-modified silicone oil.

The treatment method with silicone oil can be exemplified by the following: methods in which the silicone oil is directly mixed with the instant silane coupling agent-treated silica fine particles using a mixer such as a Henschel mixer; methods in which the silicone oil is sprayed on the instant silane coupling agent-treated silica fine particles; and methods in which the silicone oil is dissolved or dispersed in a suitable solvent, this is added to and mixed with the instant silane coupling agent-treated silica fine particles, and the solvent is removed.

The amount of the base material treated with the silicone oil, per 100 mass parts of the base material, is preferably 1.0 mass parts to 40.0 mass parts and more preferably 3.0 mass parts to 35.0 mass parts.

The hydrophobicity of the external additive can be further enhanced when the amount of the base material treated is in the indicated range.

The base material can be exemplified by inorganic fine particles, resin fine particles, and organic/inorganic composite fine particles formed of a resin and an inorganic material.

The inorganic fine particles can be exemplified by metal oxide fine particles, composite metal oxide fine particles comprising a plurality of metal oxide species, titanate salt fine particles, and carbonate salt fine particles.

The inorganic fine particles can be specifically exemplified by metal oxide fine particles, e.g., silica fine particles, alumina fine particles, titania fine particles, zinc oxide fine particles, nickel oxide fine particles, cerium oxide fine particles, zeolite fine particles, barium titanate fine particles, strontium titanate fine particles, zirconium titanate fine particles, and calcium carbonate fine particles, and by composite metal oxide fine particles, e.g., silica-alumina mixed oxide fine particles.

The resin fine particles can be specifically exemplified by acrylic resin fine particles, e.g., polymethyl methacrylate resin fine particles, and by fluororesin fine particles, e.g., polytetrafluoroethylene fine particles and vinylidene fluoride fine particles.

The organic/inorganic composite fine particles can be exemplified by composite fine particles formed from a resin, e.g., polystyrene, polymethyl methacrylate, and so forth, and an inorganic material, e.g., silica, titania, alumina, and so forth.

Among these base materials, inorganic fine particles are preferred from the standpoints of the degree of the attachability and adherence to the silane coupling agent and support for long-term maintenance of the amount of charge in high-temperature, high-humidity environments.

Among the inorganic fine particles, at least one selected from the group consisting of silica fine particles, alumina fine particles, titania fine particles, zinc oxide fine particles, strontium titanate fine particles, cerium oxide fine particles, calcium carbonate fine particles, and silica-alumina mixed oxide fine particles is preferred from the standpoint of the efficiency of the surface treatment with the isocyanurate ring-bearing silane coupling agent. Using the inorganic fine particles as the base material can provide a higher hydrophobicity and a faster charge rise rate.

The number-average particle diameter of primary particles of the base material is preferably 5 nm to 200 nm.

There are no particular limitations on the method for executing the surface treatment on the base material using the isocyanurate ring-bearing silane coupling agent and the additional other silane compound (also collectively referred to hereinbelow as "silane coupling agent"), and known methods, e.g., dry methods and wet methods, can be used.

Dry methods are methods in which the treatment agent, containing the silane coupling agent and so forth, is sprayed while the base material is being stirred and mixed in a mixer; stirring and mixing are maintained for a prescribed period of time; and the base material is then dried.

Spraying is preferably carried out using treatment agent diluted with a solvent, and, for example, water, an alcohol, toluene, and so forth can be used as the solvent. A catalyst, e.g., an amine, ammonia, acetic acid, hydrochloric acid, and so forth, may also be added.

Wet methods are methods in which, inter alia, a prescribed amount of the silane coupling agent is dissolved in a solvent in which the base material is dispersed, in order to bring the silane coupling agent into contact with the surface of the base material, after which the solvent is removed. For example, water, an alcohol, toluene, and so forth can be used as the solvent. A catalyst, e.g., an amine, ammonia, acetic acid, hydrochloric acid, and so forth, may also be added.

The toner has a toner particle and the toner external additive at the surface of the toner particle.

The toner particle may contain a known binder resin, a known colorant, a known wax, a known charge control agent, and so forth.

The method for producing the toner particle is not particularly limited, and, for example, a pulverization method, emulsion aggregation method, suspension polymerization method, or dissolution suspension method may be used for the production method. Among these, the emulsion aggregation method and suspension polymerization method, which facilitate the generation of a uniform approximately spherical shape and exhibit an excellent uniformity in the charge distribution, are preferably used.

The suspension polymerization method is a method in which a polymerizable monomer composition containing, for example, a polymerizable monomer that can produce a binder resin, a colorant, a wax, and a charge control agent is dispersed in an aqueous medium to form particles of the polymerizable monomer composition, and the polymerizable monomer in the particles is polymerized to obtain toner particles.

In the emulsion aggregation method, a toner particle is obtained, for example, by proceeding through the following steps.

Binder resin fine particles, colorant fine particles, wax fine particles, and so forth are dispersed and mixed in an aqueous medium to which a dispersion stabilizer has been added, in order to prepare a dispersion in which the different fine particles are dispersed. A surfactant may be added to the aqueous medium.

This is followed by the addition of an aggregating agent to the dispersion in order to induce the aggregation of the different fine particles until the particle diameter desired for the toner particle is reached; melt adhesion among the different fine particles is carried out at the same time as aggregation or thereafter. Optionally, the toner particle is obtained through the execution of heat-induced shape control.

The polymerizable monomer can be exemplified by vinyl polymerizable monomers.

The following are specific examples:

styrene; styrene derivatives such as α-methylstyrene, β-methylstyrene, o-methylstyrene, m-methylstyrene, p-methylstyrene, and 2,4-dimethylstyrene; acrylic polymerizable monomers such as methyl acrylate, ethyl acrylate, n-propyl acrylate, isopropyl acrylate, n-butyl acrylate, isobutyl acrylate, tert-butyl acrylate, and 2-ethylhexyl acrylate; methacrylic polymerizable monomers such as methyl methacrylate, ethyl methacrylate, n-propyl methacrylate, isopropyl methacrylate, n-butyl methacrylate, isobutyl methacrylate, and tert-butyl methacrylate; esters of methylene aliphatic monocarboxylic acids; and vinyl esters such as vinyl acetate, vinyl propionate, vinyl butyrate, vinyl benzoate, and vinyl formate.

The colorant can be exemplified by known organic pigments and dyes, carbon black, and magnetic bodies. A pigment may be used by itself, or a pigment may be used in combination with a dye.

Examples of magenta-colored pigments are C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:1, 48:2, 48:3, 48:4, 48:5, 49, 50, 51, 52, 53, 54, 55, 57:1, 58, 60, 63, 64, 68, 81:1, 81:2, 81:3, 81:4, 81:5, 83, 87, 88, 89, 90, 112, 114, 122, 123, 146, 147, 150, 163, 184, 185, 202, 206, 207, 209, 238, 269, and 282; C. I. Pigment Violet 19; and C. I. Vat Red 1, 2, 10, 13, 15, 23, 29, and 35.

Cyan-colored pigments can be exemplified by copper phthalocyanine compounds and derivatives thereof, anthraquinone compounds, and basic dye lake compounds.

Specific examples are C. I. Pigment Blue 1, 7, 15, 15:1, 15:2, 15:3, 15:4, 60, 62, and 66.

Yellow-colored pigments can be exemplified by compounds such as condensed azo compounds, isoindolinone compounds, anthraquinone compounds, azo-metal complexes, methine compounds, and allylamide compounds.

Specific examples are C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185, and C. I. Vat Yellow 1, 3, and 20.

The following can be used as black colorants: carbon black, aniline black, acetylene black, titanium black, iron oxide, and black colorants provided by color mixing the aforementioned yellow, magenta, and cyan colorants to give a black color.

The colorant content in the toner particle should be an amount that can provide the desired coloring effect, but is not otherwise particularly limited. It may be, for example, 3.0 mass parts to 15.0 mass parts per 100 mass parts of the binder resin or polymerizable monomer.

The wax can be exemplified by petroleum waxes, e.g., paraffin waxes, microcrystalline waxes, and petrolatum, and derivatives thereof; montan wax and derivatives thereof; hydrocarbon waxes provided by the Fischer-Tropsch method, and derivatives thereof; polyolefin waxes as represented by polyethylene, and derivatives thereof; and natural waxes as represented by carnauba wax and candelilla wax, and derivatives thereof. The derivatives include oxides and block copolymers and graft modifications with vinyl monomers. Additional examples are alcohols such as higher aliphatic alcohols, fatty acids such as stearic acid and palmitic acid and the acid amides and esters of these compounds, hardened castor oil and derivatives thereof, plant waxes, and animal waxes. A single one of these waxes may be used or a mixture of two or more may be used.

The wax content in the toner particle, per 100 mass parts of the binder resin or polymerizable monomer, is preferably from 2.5 mass parts to 15.0 mass parts.

The effect exercised by the wax on the charging characteristics of the toner can be minimized, while maintaining the oilless fixing performance, by having the wax content fall in the indicated range.

Negative-charging charge control agents can be exemplified by polymer compounds having a sulfonic acid group, sulfonate salt group, or sulfonate ester group; salicylic acid derivatives and metal complexes thereof; monoazo metal compounds; acetylacetone-metal compounds; aromatic hydroxycarboxylic acids, aromatic monocarboxylic acids, and aromatic polycarboxylic acids, and their metal salts, anhydrides, and esters; phenol derivatives, e.g., of bisphenol; urea derivatives; boron compounds; and calixarene.

A single one of these negative-charging charge control agents can be used by itself or a mixture of two or more can be used.

Positive-charging charge control agents, on the other hand, can be exemplified by nigrosine and modifications of nigrosine by, e.g., fatty acid metal salts; guanidine compounds; imidazole compounds; quaternary ammonium salts such as the tributylbenzylammonium salt of 1-hydroxy-4-naphthosulfonic acid and tetrabutylammonium tetrafluoroborate, and their onium salt analogues, e.g., phosphonium salts, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanide, and ferrocyanide); metal salts of higher fatty acids; diorganotin oxides such as dibutyltin oxide, dioctyltin oxide, and dicyclohexyltin oxide; and diorganotin borates such as dibutyltin borate, dioctyltin borate, and dicyclohexyltin borate.

A single one of these positive-charging charge control agents can be used by itself or a mixture of two or more can be used.

The binder resin should be able to form the toner particle, but is not otherwise particularly limited. The following different types of resins are examples:

styrene resins, acrylic resins, methacrylic resins, styrene-acrylic resins, styrene-methacrylic resins, polyethylene resins, polyethylene-vinyl acetate resins, vinyl acetate resins, polybutadiene resins, phenolic resins, polyurethane resins, polybutyral resins, polyester resins, and hybrid resins in which any of these resins are bonded.

Among the preceding, the following are preferred from the standpoint of toner properties: styrene resins, acrylic resins, methacrylic resins, styrene-acrylic resins, styrene-methacrylic resins, polyester resins, and hybrid resins in which a polyester resin is bonded with a styrene-acrylic resin or a styrene-methacrylic resin.

A single one of these resins may be used by itself or a mixture of two or more may be used.

The dispersion stabilizer can be exemplified by calcium phosphate compounds, aluminum phosphate compounds, magnesium phosphate compounds, calcium hydroxide compounds, aluminum hydroxide compounds, magnesium hydroxide compounds, calcium carbonate compounds, aluminum carbonate compounds, and magnesium carbonate compounds.

The particle diameter of the toner particle can be controlled through this dispersion stabilizer. In addition, the metal element originating with the dispersion stabilizer will be present on the toner particle surface, which facilitates bonding between the toner particle and resin particles via the metal element and thereby supports an increased strength of toner particle/resin particle attachment.

A known cationic surfactant, anionic surfactant, or nonionic surfactant can be used as the surfactant.

The cationic surfactant can be exemplified by dodecylammonium bromide, dodecyltrimethylammonium bromide, dodecylpyridinium chloride, dodecylpyridinium bromide, and hexadecyltrimethylammonium bromide.

The nonionic surfactant can be exemplified by dodecyl polyoxyethylene ether, hexadecyl polyoxyethylene ether, nonylphenyl polyoxyethylene ether, lauryl polyoxyethylene ether, sorbitan monooleate polyoxyethylene ether, stearylphenyl polyoxyethylene ether, and monodecanoylsucrose.

The anionic surfactant can be exemplified by aliphatic soaps such as sodium stearate and sodium laurate as well as by sodium lauryl sulfate, sodium dodecylbenzenesulfonate, and sodium polyoxyethylene(2) lauryl ether sulfate.

The aggregating agent can be exemplified by salts of monovalent metals such as sodium and potassium; salts of divalent metals such as calcium and magnesium; salts of trivalent metals such as iron and aluminum; and alcohols such as methanol, ethanol, and propanol.

The measurement methods are described hereinbelow.

Weight-Average Particle Diameter (D4) of the Toner Particle

The weight-average particle diameter (D4) of the toner particle is determined as follows.

The measurement instrument used is a "Coulter Counter Multisizer 3" (registered trademark, Beckman Coulter, Inc.), a precision particle size distribution measurement instrument operating on the pore electrical resistance method and equipped with a 100-μm aperture tube.

The measurement conditions are set and the measurement data are analyzed using the accompanying dedicated software, i.e., "Beckman Coulter Multisizer 3 Version 3.51" (Beckman Coulter, Inc.). The measurements are carried out in 25,000 channels for the number of effective measurement channels.

The aqueous electrolyte solution used for the measurements is prepared by dissolving special-grade sodium chloride in deionized water to provide a concentration of approximately 1 mass % and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the "threshold value/noise level measurement button". In addition, the current is set to 1600 μA; the gain is set to 2; the electrolyte solution is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the dedicated software.

(2) Approximately 30 mL of the aqueous electrolyte solution is introduced into a 100-mL flatbottom glass beaker, and to this is added as dispersing agent approximately 0.3 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of deionized water is introduced into the water tank of the ultrasound disperser and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner particle is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the dedicated software provided with the instrument and the weight-average particle diameter (D4) is calculated. When set to graph/volume % with the dedicated software, the "average diameter" on the "analysis/volumetric statistical value (arithmetic average)" screen is the weight-average particle diameter (D4).

Method for Measuring the Hydrophobicity (Volume %) of the External Additive

The hydrophobicity (volume %) of the external additive is measured using a "WET-100P" powder wettability tester from Rhesca Co., Ltd.

A fluororesin-coated spindle-shaped stirring bar having a length of 25 mm and a maximum diameter of 8 mm is introduced into a cylindrical glass container having a thickness of 1.75 mm and a diameter of 5 cm.

70 mL of aqueous methanol composed of 50 volume % methanol and 50 volume % water is introduced into the aforementioned cylindrical glass container. 0.5 g of the external additive is then added and this is set in the powder wettability tester.

While stirring at a rate of 200 rpm using a magnetic stirrer, methanol is added to the liquid through the powder wettability tester at a rate of 0.8 mL/minute.

The transmittance of light with a wavelength of 780 nm is measured, and the hydrophobicity is taken to be the value represented by the volume percentage of methanol (=(volume of methanol/volume of mixture)×100) when the transmittance has reached 50%. The initial volume ratio between the methanol and water is adjusted as appropriate in correspondence to the hydrophobicity of the sample.

EXAMPLES

This disclosure is described hereinbelow in greater detail using specific production methods, examples, and comparative examples, but these in no way limit this disclosure.

Unless specifically indicated otherwise, the number of parts in the following blends are on a mass basis in all instances.

External Additive A1 Production Example 100.0 parts of silica fine particles (product name: AEROSIL 200, number-average particle diameter of primary particles=12 nm) constituting the base material was dispersed in 300.0 parts of toluene and 10.0 parts of tris(3-trimethoxysilylpropyl) isocyanurate was added.

The was followed by wet milling for 4 hours with a planetary ball mill using zirconia balls having a diameter of 0.5 mm. Filtration was then performed and the resulting cake was dried for 8 hours at 120° C. under a vacuum and was then pulverized. A speed mill was used for the pulverization to yield an external additive A1.

External Additives A2 to A15 and External Additives B1 to B3 Production Example

External additives A2 to A15 and external additives B1 to B3 were obtained proceeding as in the External Additive A1 Production Example, but changing the type of base material used, the type of external additive used, and the treatment amount to that indicated in Table 1. The base material and treatment agent for the produced external additives and the properties of the external additives (hydrophobicity) are given in Table 1.

(Product name: AEROSIL MOX170, number-average particle diameter of primary particles=15 nm) was used for the "silica-alumina mixed oxide fine particles" used for External Additive A9.

The "acrylic resin fine particles" used for external additives A11 to A15 are polymethyl methacrylate resin fine particles.

TABLE 1

| External additive No. | Base material (number-average particle diameter of primary particles) | Treatment agent (number of parts of addition per 100 parts of the base material) | Hydrophobicity (volume %) |
|---|---|---|---|
| A1 | silica fine particles (12 nm) | tris(3-trimethoxysilylpropyl) isocyanurate (10.0 parts) | 71 |
| A2 | silica fine particles (12 nm) | tris(3-trimethoxysilylpropyl) isocyanurate (5.0 parts) n-propyltrimethoxysilane (5.0 parts) | 74 |
| A3 | titania fine particles (7 nm) | tris(3-trimethoxysilylpropyl) isocyanurate (10.0 parts) | 67 |
| A4 | alumina fine particles (20 nm) | tris(3-trimethoxysilylpropyl) isocyanurate (10.0 parts) | 69 |
| A5 | zinc oxide fine particles (35 nm) | tris(3-trimethoxysilylpropyl) isocyanurate (10.0 parts) | 64 |
| A6 | strontium titanate fine particles (80 nm) | tris(3-trimethoxysilylpropyl) isocyanurate (10.0 parts) | 62 |
| A7 | cerium oxide fine particles (150 nm) | tris(3-trimethoxysilylpropyl) isocyanurate (10.0 parts) | 66 |
| A8 | calcium carbonate fine particles (80 nm) | tris(3-trimethoxysilylpropyl) isocyanurate (10.0 parts) | 64 |
| A9 | silica-alumina mixed oxide fine particles (15 nm) | tris(3-trimethoxysilylpropyl) isocyanurate (10.0 parts) | 70 |
| A10 | barium titanate fine particles (100 nm) | tris(3-trimethoxysilylpropyl) isocyanurate (10.0 parts) | 59 |
| A11 | acrylic resin fine particles (150 nm) | tris(3-trimethoxysilylpropyl) isocyanurate (10.0 parts) | 65 |
| A12 | acrylic resin fine particles (150 nm) | tris(3-triethoxysilylpropyl) isocyanurate (10.0 parts) | 62 |
| A13 | acrylic resin fine particles (150 nm) | tris(3-methyldimethoxysilylpropyl) isocyanurate (10.0 parts) | 57 |
| A14 | acrylic resin fine particles (150 nm) | tris(3-methyldimethoxysilylpropyl) isocyanurate (35.0 parts) | 55 |
| A15 | acrylic resin fine particles (150 nm) | 1-(3-trimethoxysilylpropyl)-3,5-bis(carboxymethyl) isocyanurate (35.0 parts) | 51 |
| B1 | silica fine particles (12 nm) | n-propyltrimethoxysilane (10.0 parts) | 73 |
| B2 | silica fine particles (12 nm) | perfluorooctyltriethoxysilane (10.0 parts) | 18 |
| B3 | silica fine particles (12 nm) | perfluorooctyltriethoxysilane (5.0 parts) n-propyltrimethoxysilane (5.0 parts) | 42 |

Toner Particle 1 Production Example

Polymerizable Monomer Composition Preparation Example

The following components were mixed and then dispersed for 3 hours with a ball mill.

| | |
|---|---|
| styrene | 82.0 parts |
| 2-ethylhexyl acrylate | 18.0 parts |
| divinylbenzene | 0.1 parts |
| C.I. Pigment Blue 15:3 | 5.5 parts |
| polyester resin | 5.0 parts |

Polycondensate of isophthalic acid and propylene oxide-modified bisphenol A (glass transition temperature=65° C., weight-average molecular weight (Mw)=10,000, number-average molecular weight (Mn)=6,000).

After heating the resulting dispersion to 60° C. while stirring at 300 rpm, 12.0 parts of an ester wax (peak temperature of the maximum endothermic peak in differential scanning calorimetric measurement=70° C., number-average molecular weight (Mn)=704) and 3.0 parts of 2,2'-azobis(2,4-dimethylvaleronitrile) were added and dissolved to provide a polymerizable monomer composition.

Aqueous Dispersion Medium Preparation Example 710 parts of deionized water and 450 parts of a 0.1 mol/L aqueous sodium phosphate solution were added to a 2-L four-neck flask fitted with a T. K. Homomixer high speed-stirrer (PRIMIX Corporation), and heating was carried out to 60° C. while stirring at 12,000 rpm. To this was gradually added 68.0 parts of a 1.0 mol/L aqueous calcium chloride solution to prepare an aqueous dispersion medium that contained calcium phosphate as a sparingly water-soluble microtine dispersion stabilizer.

Granulation/Polymerization Step

The polymerizable monomer composition was introduced into the aqueous dispersion medium and granulation was carried out for 15 minutes while maintaining the 12,000 rpm rotation rate. The high-speed stirrer was then replaced with a stirrer having a propeller stirring blade and polymerization was continued for 5 hours at an internal temperature of 60° C. The internal temperature was subsequently raised to 80° C. and polymerization was continued for another 3 hours. After the completion of the polymerization reaction, the residual monomer was distilled off under reduced pressure at 80° C., followed by cooling to 30° C. to obtain a fine polymer particle dispersion.

Washing/Drying Step

The resulting fine polymer particle dispersion was transferred to a wash vessel and dilute hydrochloric acid was added while stirring to adjust the pH to 1.5. The dispersion was stirred for 2 hours followed by solid/liquid separation with a filter to obtain polymer fine particles.

The obtained polymer fine particles were introduced into 1.0 L of deionized water with stirring to prepare another dispersion; this was followed by solid/liquid separation with a filter. After this procedure had been carried out three times, the polymer fine particles from the final solid/liquid separation were thoroughly dried in a dryer at 30° C. to obtain a toner particle 1 having a weight-average particle diameter (D4) of 6.8 μm.

Toner 1 Production Example 1.0 parts of a hexamethyldisilazane-surface treated fumed silica (number-average particle diameter of primary particles=7 nm) and 1.0 parts of external additive A1 were mixed with 100 parts of toner particle 1 using an FM mixer (NIPPON COKE & ENGINEERING CO., LTD.).

The conditions for this external addition were an external addition time of 30 minutes at a stirring rate of 3,600 rpm using 1.8 kg for the amount of toner particle introduction. This was followed by sieving on a mesh with an aperture of 200 μm to obtain a toner 1.

Toners 2 to 15 and Comparative Toners 1 to 3 Production Example

Toners 2 to 15 and comparative toners 1 to 3 were obtained proceeding as in the Toner 1 Production Example, but changing the external additive A1 that was used to that described in Table 2.

TABLE 2

| Toner No. | Number of parts of addition of fumed silica | External additive No. and (number of parts of addition) |
|---|---|---|
| 1 | 1.0 | External additive A1 (1.0 part) |
| 2 | 1.0 | External additive A2 (1.0 part) |
| 3 | 1.0 | External additive A3 (1.0 part) |

TABLE 2-continued

| Toner No. | Number of parts of addition of fumed silica | External additive No. and (number of parts of addition) |
|---|---|---|
| 4 | 1.0 | External additive A4 (1.0 part) |
| 5 | 1.0 | External additive A5 (1.0 part) |
| 6 | 1.0 | External additive A6 (1.0 part) |
| 7 | 1.0 | External additive A7 (1.0 part) |
| 8 | 1.0 | External additive A8 (1.0 part) |
| 9 | 1.0 | External additive A9 (1.0 part) |
| 10 | 1.0 | External additive A10 (1.0 part) |
| 11 | 1.0 | External additive A11 (1.0 part) |
| 12 | 1.0 | External additive A12 (1.0 part) |
| 13 | 1.0 | External additive A13 (1.0 part) |
| 14 | 1.0 | External additive A14 (1.0 part) |
| 15 | 1.0 | External additive A15 (1.0 part) |
| comparative 1 | 1.0 | External additive B1 (1.0 part) |
| comparative 2 | 1.0 | External additive B2 (1.0 part) |
| comparative 3 | 1.0 | External additive B3 (1.0 part) |

Example 1

Toner 1 was evaluated according to the following criteria using the following evaluation methods.

A modified version of an LBP7700C (Canon Inc.) was used as the evaluation machine wherein the process speed of the main unit had been modified to 350 mm/sec; toner 1 was filled in the cyan cartridge.

Presuming cartridge downsizing, the diameter of the toner carrying member within the cartridge was also changed to 9 mm.

Evaluation of the Charge Rise Rate

The charge rise rate of the toner was evaluated by briefly shaking a two-component developer, prepared by the following method, and measuring the amount of charge of the toner.

0.5 g of the toner and 9.5 g of carrier N-01 (produced by The Imaging Society of Japan) were introduced into a 50-mL polypropylene container and were held for 24 hours in a normal-temperature, normal-humidity environment (23° C., 50% RH). This was followed by shaking for 10 seconds at a shaking rate of 200 times per 1 minute, and measurement was then performed using a TB-200 (Toshiba Chemical Corporation) for measurement of the amount of charge by powder blow off. The blow-off time was 2 minutes.

The charge rise was evaluated using the following criteria.

A: the amount of triboelectric charge is equal to or less than −20.0 μC/g

B: the amount of triboelectric charge is −10.0 μC/g to −19.9 μC/g

C: the amount of triboelectric charge is −5.0 μC/g to −9.9 μC/g

D: the amount of triboelectric charge is equal to or greater than −4.9 μC/g

Evaluation of the Charge Stability

The evaluation was carried out in a high-temperature, high-humidity environment (30° C., 80% RH), which readily exercises an effect on charge stability. XEROX 4200 paper (Xerox Corporation, 75 g/m$^2$) was used for the evaluation paper.

Postulating an extended repetitive use test that would severely task the toner, and while operating in a high-temperature, high-humidity environment, 15,000 prints were made of a horizontal line pattern having a print percentage of 1%, in an intermittent durability test in which two prints were output every 5 seconds. The image density was measured at the 15,000th print.

For the image density, a 5-mm circular solid image was output and the reflection density was measured using a MacBeth reflection densitometer (MacBeth Corporation) with an SPI filter.

Here, a higher image density indicates a better charge stability. The evaluation criteria are as follows.

A: the image density is at least 1.40

B: the image density is at least 1.35, but less than 1.40

C: the image density is at least 1.20, but less than 1.35

D: the image density is less than 1.20

Examples 2 to 15 and Comparative Examples 1 to 3

The same evaluations as in Example 1 were carried out using toners 2 to 15 and comparative toners 1 to 3. The results of the evaluations are given in Table 3.

TABLE 3

| | Toner No. | Charge rise rate | Charge stability |
|---|---|---|---|
| Example 1 | 1 | A | A |
| Example 2 | 2 | A | A |
| Example 3 | 3 | A | A |
| Example 4 | 4 | A | A |
| Example 5 | 5 | A | A |
| Example 6 | 6 | A | A |
| Example 7 | 7 | A | A |
| Example 8 | 8 | A | A |
| Example 9 | 9 | A | A |
| Example 10 | 10 | B | A |
| Example 11 | 11 | B | B |
| Example 12 | 12 | B | B |
| Example 13 | 13 | B | B |
| Example 14 | 14 | B | B |
| Example 15 | 15 | B | B |
| Comparative Example 1 | comparative 1 | D | D |
| Comparative Example 2 | comparative 2 | D | D |
| Comparative Example 3 | comparative 3 | C | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-051296, filed Mar. 19, 2019 which is hereby incorporated by reference herein in its entirety.

What is claimed is:

1. A toner, comprising:

a toner particle; and a toner external additive on a surface of the toner particle, the toner external additive comprising a base material that is surface-treated with an isocyanurate ring-bearing silane coupling agent.

2. The toner according to claim 1, wherein an amount of the base material treated with the silane coupling agent is 0.1 to 30.0 mass parts per 100 mass parts of the base material.

3. The toner according to claim 1, wherein the silane coupling agent is at least one member selected from the group consisting of a silane compound represented by formula (1) and hydrolyzates of the silane compound (I)

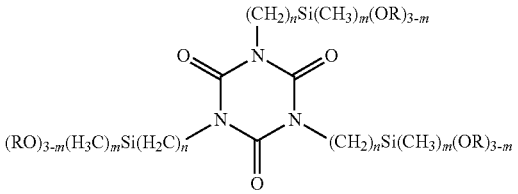

where each R independently represents a $C_{1-6}$ monovalent hydrocarbon group, n represents an integer from 1 to 10, and m represents 0 or 1.

4. The toner according to claim 1, wherein the silane coupling agent is at least one member selected from the group consisting of tris(3-trimethoxysilylpropyl) isocyanurate and hydrolyzates thereof, and tris(3-triethoxysilylpropyl) isocyanurate and hydrolyzates thereof.

5. The toner according to claim 1, wherein the base material is an inorganic fine particle.

6. The toner according to claim 5, wherein the inorganic fine particle is at least one member selected from the group consisting of silica fine particles, alumina fine particles, titania fine particles, zinc oxide fine particles, strontium titanate fine particles, cerium oxide fine particles, calcium carbonate fine particles, and silica-alumina mixed oxide fine particles.

* * * * *